US007775782B2

(12) United States Patent
Choi et al.

(10) Patent No.: US 7,775,782 B2
(45) Date of Patent: Aug. 17, 2010

(54) VARIABLE CAPACITY ROTARY COMPRESSOR HAVING VANE CONTROLLER

(75) Inventors: Ji Hoon Choi, Hwaseong-si (KR); Jeong Il Park, Hwaseong-si (KR); Jeong Hoon Kang, Seoul (KR); Phil Soo Chang, Seongnam-si (KR); Kyung Rae Cho, Suwon-si (KR); Jin Kyu Choi, Suwon-si (KR); Hyeong Joon Seo, Suwon-si (KR); In Ju Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 462 days.

(21) Appl. No.: 11/898,049

(22) Filed: Sep. 7, 2007

(65) Prior Publication Data

US 2008/0175736 A1 Jul. 24, 2008

(30) Foreign Application Priority Data

Jan. 19, 2007 (KR) ..... 10-2007-0006259

(51) Int. Cl.
*F03C 2/00* (2006.01)
*F03C 4/00* (2006.01)
*F04C 2/00* (2006.01)

(52) U.S. Cl. ..... 418/23; 418/11; 418/60; 418/181; 418/270; 417/213; 417/220; 417/310

(58) Field of Classification Search ..... 418/11, 418/23–27, 60, 63, 270, 181; 417/213, 218, 417/220, 310

See application file for complete search history.

(56) References Cited

U.S. PATENT DOCUMENTS

| | | | | |
|---|---|---|---|---|
| 3,975,123 | A * | 8/1976 | Schibbye | 418/97 |
| 4,600,076 | A * | 7/1986 | Yamamoto et al. | 181/233 |
| 5,518,381 | A * | 5/1996 | Matsunaga et al. | 418/60 |
| 6,045,344 | A * | 4/2000 | Tsuboi et al. | 418/DIG. 1 |
| 6,716,007 | B2 * | 4/2004 | Kim et al. | 418/23 |

FOREIGN PATENT DOCUMENTS

| | | | | |
|---|---|---|---|---|
| JP | 01247786 | A * | 10/1989 | 418/23 |
| KR | 10-621026 | | 8/2006 | |

OTHER PUBLICATIONS

Chinese Office Action issued on Jul. 17, 2009 in corresponding Chinese Patent Application 200710153504.7.

* cited by examiner

*Primary Examiner*—Theresa Trieu
(74) *Attorney, Agent, or Firm*—Staas & Halsey LLP

(57) ABSTRACT

A variable capacity rotary compressor capable of reducing collision noise of a vane with a roller. The variable capacity rotary compressor includes a vane controller controlling the operation of a vane in order to vary compression capacity. The vane controller includes a control valve that switches a fluid channel so as to selectively apply discharge pressure and intake pressure to the vane guide slot, a connection channel that connects the control valve with the vane guide slot, a high-pressure channel that connects the control valve with a discharge side of the compressor, and a low-pressure channel that connects the control valve with an intake side of the compressor, and a throttle section that reduces the fluid channel of at least one of the high-pressure channel and the connection channel in order to reduce an initial discharge pressure applied to the vane guide slot.

2 Claims, 8 Drawing Sheets

VARIABLE CAPACITY ROTARY COMPRESSOR HAVING VANE CONTROLLER

CROSS-REFERENCE TO RELATED APPLICATIONS

This application claims the benefit of Korean Patent Application No. 2007-6259, filed on Jan. 19, 2007, in the Korean Intellectual Property Office, the disclosure of which is incorporated herein by reference.

BACKGROUND

1. Field

The present invention relates generally to a variable capacity rotary compressor, and more particularly to a variable capacity rotary compressor capable of varying compression capacity through the constraint and release of a vane.

2. Description of the Related Art

A variable capacity rotary compressor that varies compression capacity through the motion control of a vane is disclosed in Korean Patent No. 10-621026 (issued Sep. 15, 2006).

The rotary compressor of Korean Patent No. 10-621026 includes a vane controller that has a first vane partitioning an upper compression chamber and a second vane partitioning a lower chamber, and varies compression capacity by selectively constraining and releasing the second vane. The vane controller includes a connection pipe connected to a back-pressure space of the second vane, a high-pressure pipe connected to the connection pipe, a low-pressure pipe connected to the connection pipe, and a back-pressure switching valve installed at the junction of the pipes in the type of a three-way valve.

The vane controller is adapted to apply intake pressure to the back-pressure space of the second vane by means of switching operation of the back-pressure switching valve to thus constrain the second vane, or apply discharge pressure to the back-pressure space to thus move the second vane forwards and backwards.

However, in this rotary compressor, in the case in which the discharge pressure is applied to the back-pressure space of the second vane while the second vane is moved backwards (i.e. is in an idle state), the second vane moves toward a compression chamber by means of the discharge pressure, and thus collides with a roller, which causes noise.

SUMMARY

Accordingly, the present invention has been made to solve above-mentioned problems occurring in the prior art, and an aspect of the present invention is to provide a variable capacity rotary compressor capable of reducing collision noise of a vane with a roller.

Additional aspects and/or advantages will be set forth in part in the description which follows and, in part, will be apparent from the description, or may be learned by practice of the invention.

In order to accomplish this aspect, according to an aspect of the present invention, there is provided a variable capacity rotary compressor, which includes a housing having a compression chamber, a vane moving backwards and forwards in a radial direction of the compression chamber and partitioning the compression chamber, a vane guide slot formed in the housing in order to guide operation of the vane, and a vane controller controlling the operation of the vane in order to vary compression capacity. Here, the vane controller includes a control valve that switches a fluid channel so as to selectively apply discharge pressure and intake pressure to the vane guide slot, a connection channel that connects the control valve with the vane guide slot, a high-pressure channel that connects the control valve with a discharge side of the compressor, and a low-pressure channel that connects the control valve with an intake side of the compressor, and a throttle section that reduces the fluid channel of at least one of the high-pressure channel and the connection channel in order to reduce an initial discharge pressure applied to the vane guide slot.

Further, the vane controller may include a connection pipe forming the connection channel, a high-pressure pipe forming the high-pressure channel, and a low-pressure pipe forming the low-pressure channel.

Further, the throttle section may include a throttle pipe that is fitted in at least one of the high-pressure pipe and the connection pipe and has an inner diameter smaller than that of any one the high-pressure pipe and the connection pipe.

Also, the throttle section may be formed such that any one of the high-pressure pipe and the connection pipe is reduced in diameter.

Further, the throttle section may include a throttle pipe that is connected to at least one of the high-pressure pipe and the connection pipe and has an inner diameter smaller than that of any one of the high-pressure pipe and the connection pipe.

In addition, the throttle section may include a throttle valve that is installed on at least one of the high-pressure pipe and the connection pipe and can adjust an opening degree of the fluid channel.

According to another aspect of the present invention, there is provided a variable capacity rotary compressor, which includes a housing having first and second compression chambers partitioned from each other, first and second vanes moving backwards and forwards in radial directions of the first and second compression chambers and partitioning the first and second compression chambers, first and second vane guide slots formed in the housing in order to guide operation of the first and second vanes, and a vane controller controlling the operation of the first vane in order to vary compression capacity. Here, the vane controller includes a control valve that switches a fluid channel so as to selectively apply discharge pressure and intake pressure to the first vane guide slot, a connection channel that connects the control valve with the first vane guide slot, a high-pressure channel that connects the control valve with a discharge side of the compressor, and a low-pressure channel that connects the control valve with an intake side of the compressor, and a throttle section that reduces the fluid channel of at least one of the high-pressure channel and the connection channel in order to reduce an initial discharge pressure applied to the first vane guide slot.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EMBODIMENTS

Figure 1:
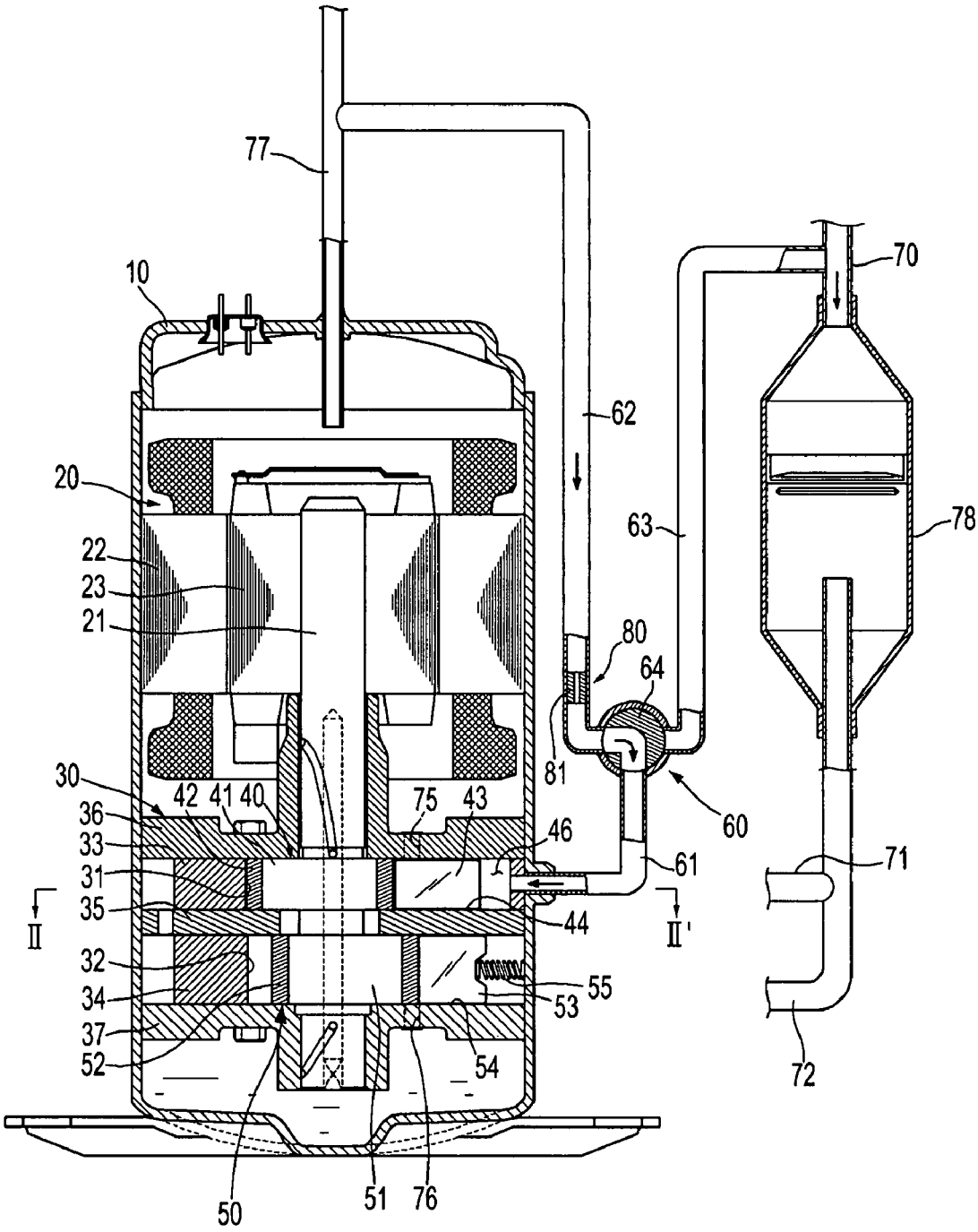
FIG. 1 is a sectional view illustrating a variable capacity rotary compressor according to the present invention, in which a first compression chamber is compressed.

Reference will now be made in detail to the embodiments, examples of which are illustrated in the accompanying drawings, wherein like reference numerals refer to the like elements throughout. The embodiments are described below to explain the present invention by referring to the figures.

As illustrated in FIG. 1, a variable capacity rotary compressor according to the present invention includes a motor element 20 installed at the inner upper portion of a closed case 10, and a compression element 30 installed at an inner lower portion of the closed case 10 and connected with the motor element 20 through a rotating shaft 21.

The motor element 20 includes a cylindrical stator 22 fixed in the closed case 10, and a rotor 23 installed rotatably in the stator 22 and coupled to the rotating shaft 21 at the center thereof. The motor element 20 is electrically powered to rotate the rotor 23, thereby driving the compression element 30 that is connected by the rotating shaft 21.

The compression element 30 includes a housing that is partitioned into first and second compression chambers 31 and 32 at upper and lower portions thereof, and first and second compression units 40 and 50 that are respectively provided in the first and second compression chambers 31 and 32 and are operated by the rotating shaft 21.

The housing of the compression element 30 includes a first body 33 that is provided with the first compression chamber 31 at an upper portion thereof, a second body 34 that is provided with the second compression chamber 32 and is installed below the first body 33, an intermediate plate 35 that is interposed between the first and second bodies 33 and 34 for the partition between the first and second compression chambers 31 and 32, and first and second flanges 36 and 37 that are respectively installed at an upper portion of the first body 33 and a lower portion of the second body 34 so as to close an upper opening of the first compression chamber 31 and a lower opening of the second compression chamber 32 and simultaneously support the rotating shaft 21. The rotating shaft 21 passes through the centers of the first and second compression chambers 31 and 32, and is connected to the first and second compression units 40 and 50 in the first and second compression chambers 31 and 32.

The first and second compression units 40 and 50 include first and second eccentric parts 41 and 51 that are installed on the rotating shaft 21 of the first and second compression chambers 31 and 32, and first and second rollers 42 and 52 that are rotatably coupled to outer peripheries of the first and second eccentric parts 41 and 51 so as to be rotated in contact with inner peripheries of the first and second compression chambers 31 and 32. The first eccentric part 41 has an eccentric direction opposite to that of the second eccentric part 51 so as to be in equilibrium.

Figure 2:
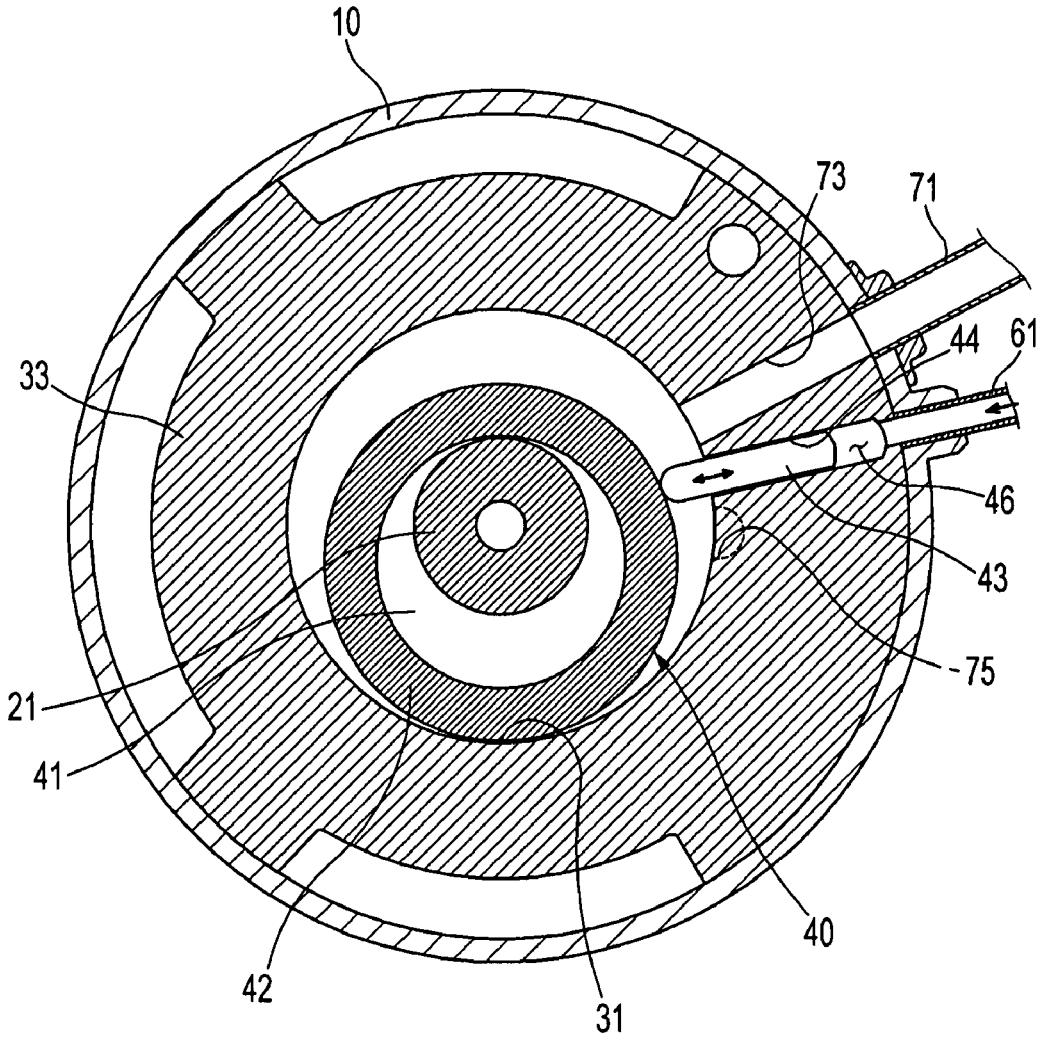
FIG. 2 is a sectional view taken from line II-II' of FIG. 1.

The first and second compression units 40 and 50 includes first and second vanes 43 and 53, which move backwards and forwards in radial directions of the compression chambers 31 and 32 by means of the rotation of the first and second rollers 42 and 52 and partition the compression chambers 31 and 32. As illustrated in FIGS. 1 and 2, the first and second vanes 43 and 53 are received in first and second vane guide slots 44 and 54 that generally extend in the radial directions of the compression chambers 31 and 32, and thereby are subjected to the guide of forward and backward movement. The second vane guide slot 54 is provided with a vane spring 55, which biases the second vane 53 toward the second roller 52 so as to allow the second vane 52 to partition the second compression chamber 32.

The first vane guide slot 44 is provided, at the rear thereof, with a closed chamber 46 that holds a rear end of the first vane 43. The closed chamber 46 is separated from the internal space of the closed case 10 by means of the intermediate plate 35 and the first flange 36. Further, the variable capacity rotary compressor of the present invention includes a vane controller 60, which constrains the first vane 43 in a retreated state by applying intake pressure to the closed chamber 46, or causes the first vane 43 to move backwards or forwards by applying discharge pressure to the closed chamber 46. The vane controller 60 allows the first compression chamber 31 to be compressed or idle by constraining or releasing the first vane 43, to thereby vary the compression capacity. The detailed construction of the vane controller 60 will be described below.

The first and second bodies 33 and 34 are provided with intake ports 73 (see FIG. 2) that are connected with intake pipes 71 and 72 so as to allow gas to flow into the first and second compression chambers 31 and 32, and discharge ports 75 and 76 that allows gas compressed in the first and second compression chambers 31 and 32 to be discharged into the closed case 10. Thus, when the compressor is operated, the closed case 10 is maintained therein under high pressure by means of the discharge ports 75 and 76, and the gas in the closed case 10 is discharged outside through a discharge piping 77 installed at the top of the closed case 10. The intake gas passes through an accumulator 78, and then is guided to the respective compression chambers 31 and 32 through the intake pipes 71 and 72.

As illustrated in FIG. 1, the vane controller 60 includes a control valve 64 switching a fluid channel, a connection pipe 61 connecting the control valve 64 with the first vane guide slot 44, a high-pressure pipe 62 connecting the control valve 64 with the discharge piping 77, and a low-pressure pipe 63 connecting the control valve 64 with the intake piping 70. The control valve 64 switches the fluid channel so as to allow the connection pipe 61 to selectively communicate with the high-pressure and low-pressure pipes 62 and 63, thereby allowing intake and discharge pressures to be selectively applied to the closed chamber 46 at the rear of the first vane guide slot 44.

The vane controller 60 is operated as follows.

Figure 3:
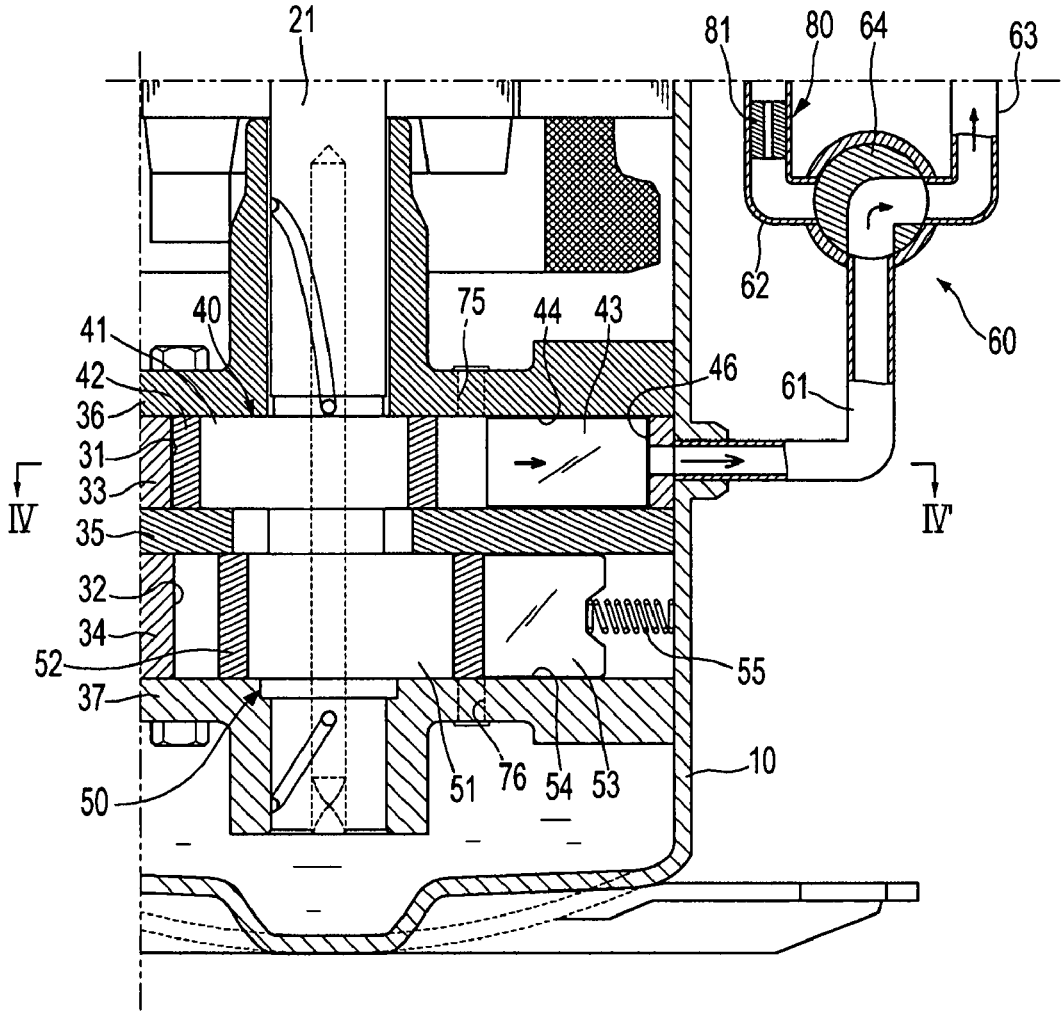
FIG. 3 is a sectional view illustrating a variable capacity rotary compressor according to the present invention, in which a first compression chamber is idle.
Figure 4:
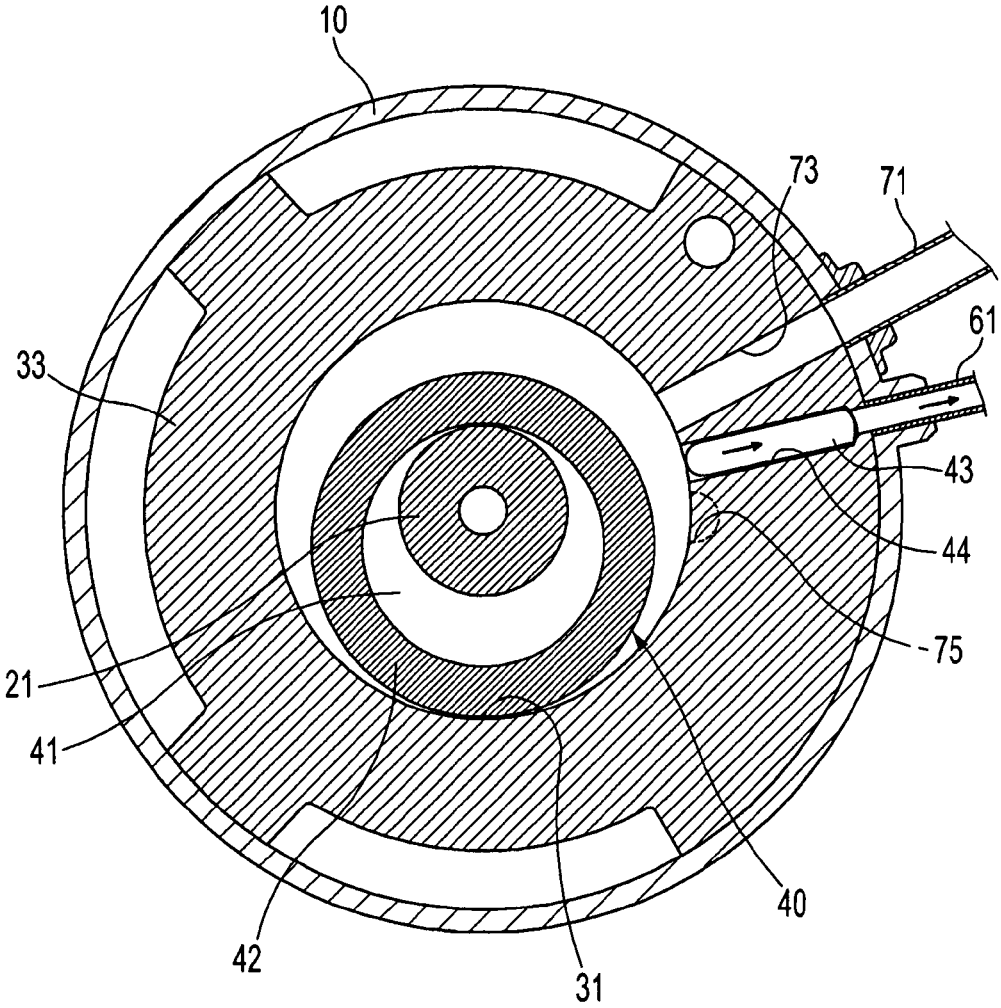
FIG. 4 is a sectional view taken from line IV-IV' of FIG. 3.

As illustrated in FIGS. 1 and 2, when the control valve 64 is operated so as to cause the high-pressure pipe 62 to communicate with the connection pipe 61, the discharge pressure is applied to the closed chamber 46. Therefore, the discharge pressure pushes the first vane 43 toward the first compression chamber 31, so that the first vane 43 moves backwards and forwards by means of the eccentric rotation of the first roller 42. In contrast, as illustrated in FIGS. 3 and 4, when the control valve 64 is operated so as to cause the low-pressure pipe 63 to communicate with the connection pipe 61, the intake pressure is applied to the closed chamber 46. Therefore, the first vane 43 is stopped in a retreated state, so that the first compression chamber 31 is idle.

In this manner, the variable capacity rotary compressor of the present invention allows the first compression chamber 31 to be compressed or idle by constraining or releasing the first vane 43 through the vane controller 60, thereby being capable of varying the compression capacity. In other words, when the first vane 43 moves backwards and forwards by applying the discharge pressure to the rear of the first vane guide slot 44, both of the first compression chamber 31 and the second compression chamber 32 are subjected to the compression.

As a result, a high capacity of compression is carried out. In contrast, as illustrated in FIGS. 3 and 4, when the first vane 43 is constrained by applying the intake pressure to the first vane guide slot 44, the first compression chamber 31 is idle, whereas only the second compression chamber 32 is compressed. As a result, the compression capacity is reduced.

Further, as illustrated in FIG. 1, the vane controller 60 includes a throttle section 80, which is installed on the high-pressure pipe 62 in order to reduce an initial discharge pressure applied to the first vane guide slot 44. The throttle section 80 includes a throttle pipe 81, which is fitted in the high-pressure pipe 62 and reduces a fluid channel because an inner diameter thereof is smaller than that of the high-pressure pipe 62.

This construction is adapted to allow discharge gas to be reduced in pressure while passing through the narrow fluid channel of the throttle pipe 81 when the first vane 43 maintains its retreated state as illustrated in FIG. 3 and then the discharge pressure is applied to the closed chamber 46 of the first vane guide slot 44 as illustrated in FIG. 1, thereby causing an initial discharge pressure applied to the first vane guide slot 44 to be reduced. When the initial discharge pressure applied to the first vane guide slot 44 is reduced, the force with which the first vane 43 is displaced toward and collided with the first roller 42 in the initial stage of operation of the first vane 43 is weakened, so that the noise caused by the collision of the first vane 43 with the first roller 42 can be reduced. In order to facilitate this function, the throttle pipe 81 preferably has an inner diameter from about 1.0 mm to about 1.5 mm, and a length from about 30 mm to about 40 mm.

Figure 5:
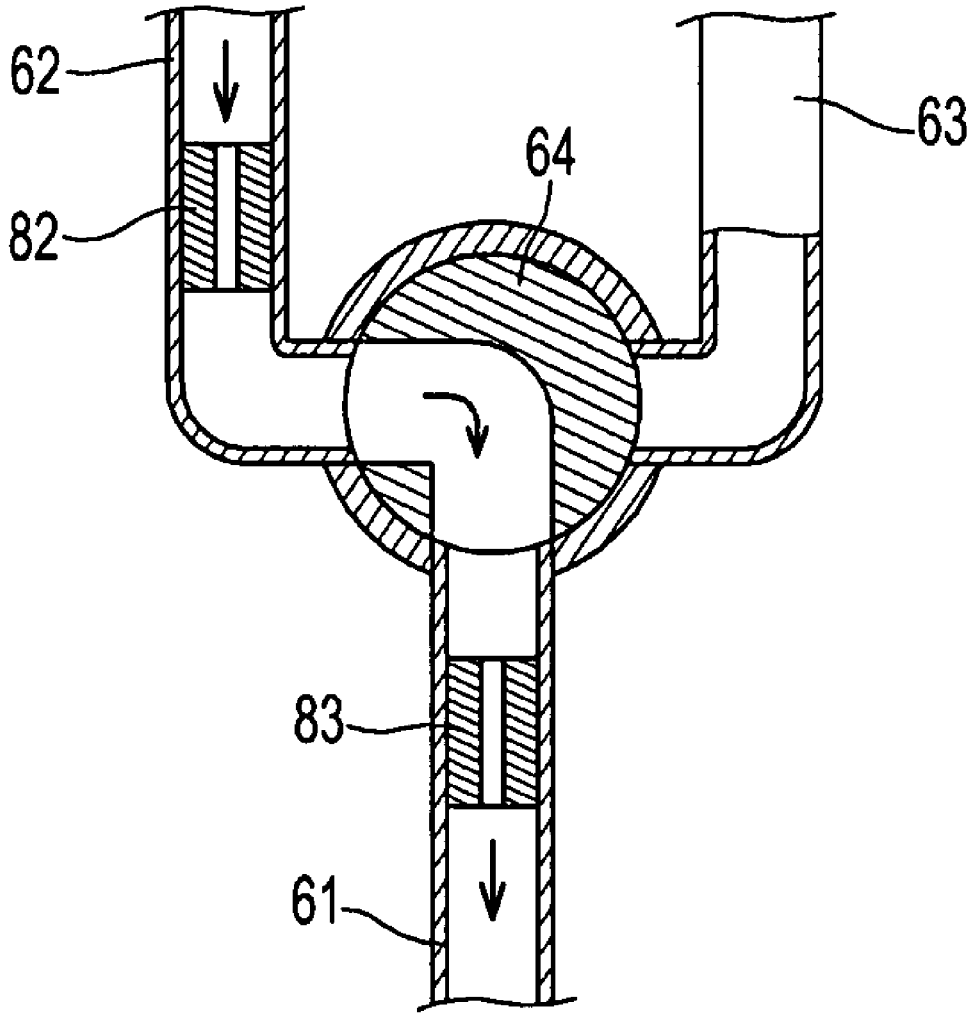
FIGS. 5, 6, 7 and 8 illustrate other embodiments of a throttle section of a vane controller of a variable capacity rotary compressor according to the present invention.

FIG. 5 illustrates an example in which a throttle section is constituted of a first throttle pipe 82 and a second throttle pipe 83 which are installed so as to be fitted in the high-pressure pipe 62 and the connection pipe 61, respectively. The throttle section has only to be provided on a path on which the discharge pressure is introduced from a discharge side of the compressor to the first vane guide slot 44, so that it may be installed on any one of the high-pressure pipe 62 and the connection pipe 61, or both of the high-pressure pipe 62 and the connection pipe 61 as in FIG. 5. The example where the first throttle pipe 82 and the second throttle pipe 83 are installed in the high-pressure pipe 62 and the connection pipe 61 respectively as in FIG. 5 can further reduce the initial discharge pressure applied to the first vane guide slot 44, so that the effect of reducing the collision noise of the first vane 43 can further increased. As a result of the test, this construction can reduce the noise caused by the collision of the first vane 43 by about 5 dB, compared to the conventional compressor without the throttle section.

Figure 6:
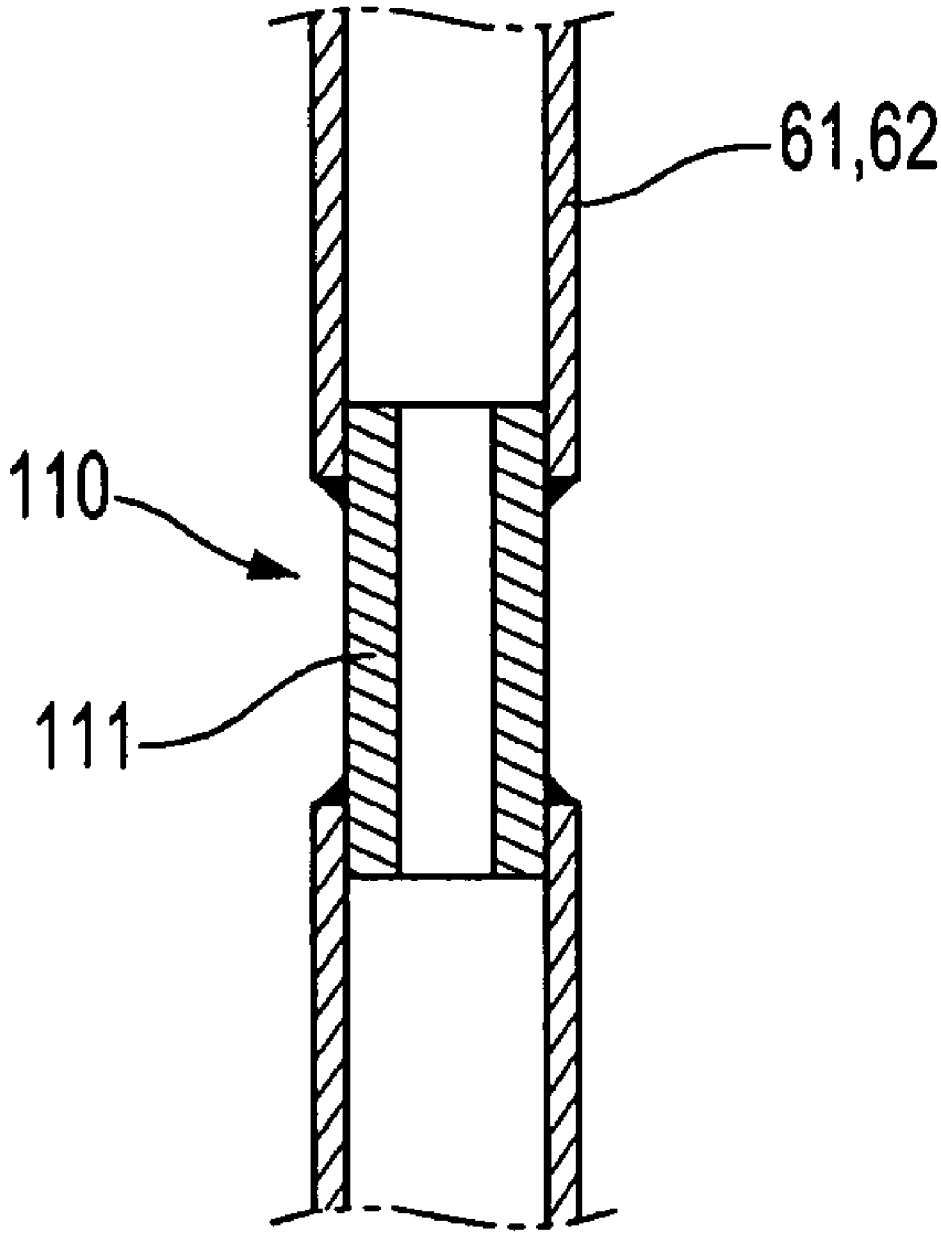
Figure 7:
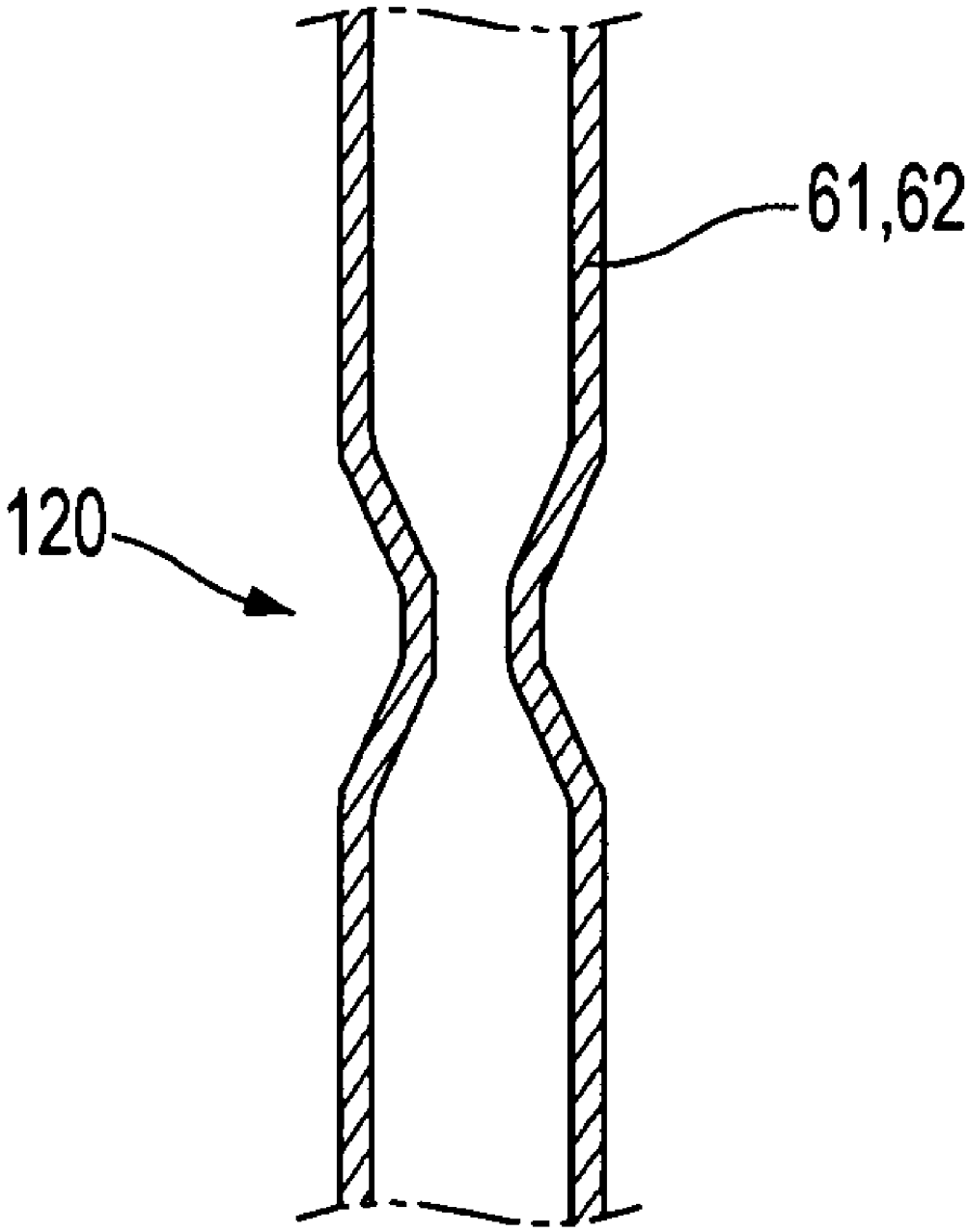
Figure 8:
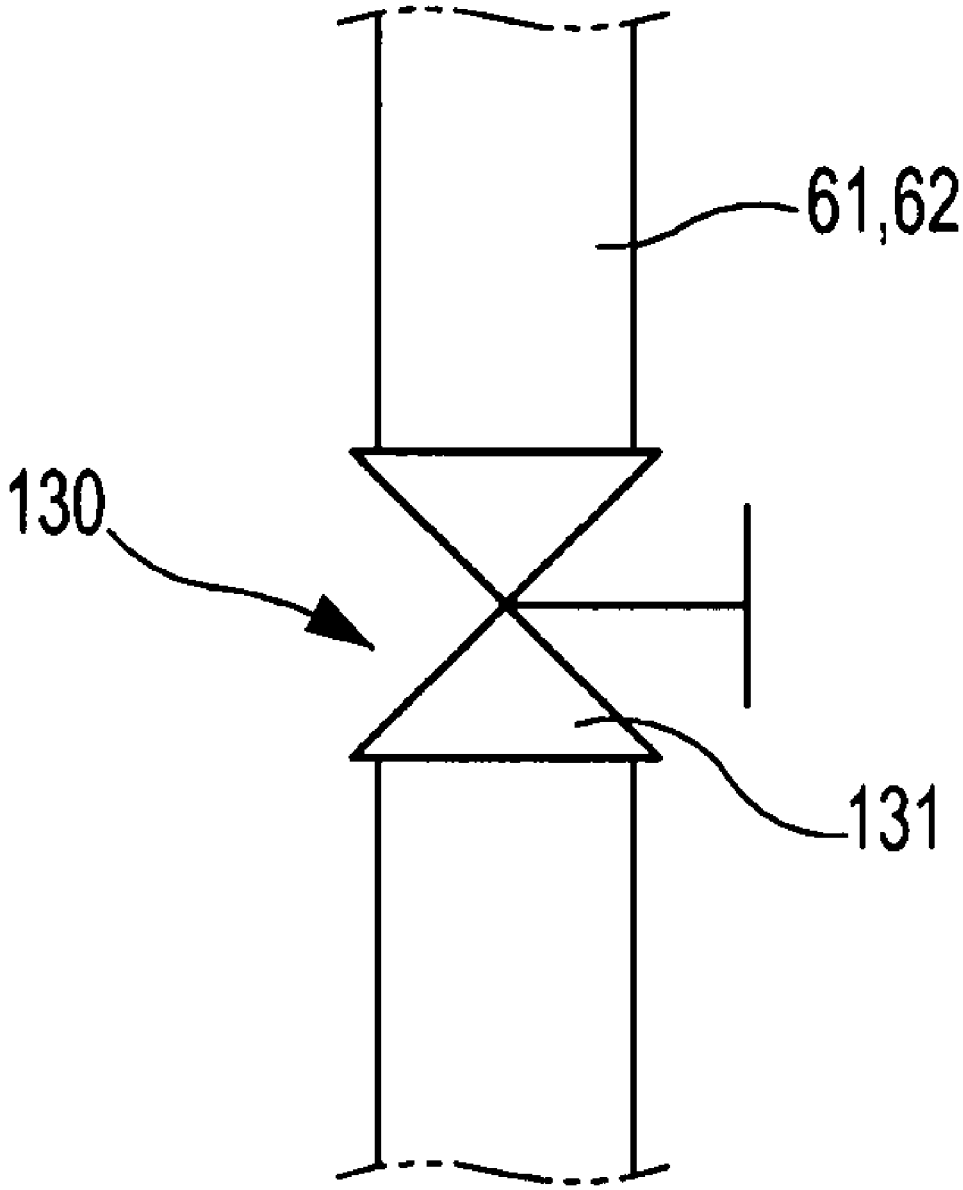

FIGS. 6, 7 and 8 illustrate another embodiment of the throttle section. The throttle section 110 of FIG. 6 is constructed such that the opposite ends of a throttle pipe 111 are connected with the high-pressure pipe 62 or the connection pipe 61 by means of welding. The throttle section 120 of FIG. 7 is formed such that a diameter of the high-pressure pipe 62 or the connection pipe 61 is reduced. The throttle section 130 of FIG. 8 is constructed such that a throttle valve 131 an opening degree of which can be adjusted is installed on the high-pressure pipe 62 or the connection pipe 61. The throttle valve 131 of FIG. 8 adjusts the opening degree of a fluid channel in a manual or automatic way, so that an initial discharge pressure applied to the first vane guide slot 44 can be adjusted.

As described in detail above, the variable capacity rotary compressor according to the present invention can reduce an initial discharge pressure applied to a vane guide slot can be adjusted through a throttle section installed on the high-pressure pipe or the connection pipe of the vane controller, so that the collision noise of the vane with the roller can be reduced.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A variable capacity rotary compressor comprising:

a housing having a compression chamber;

a compression element installed in the compression chamber, the compression element being connected to a motor element through a rotating shaft;

a vane moving backwards and forwards in a radial direction of the compression chamber and partitioning the compression chamber;

a vane guide slot formed in the housing in order to guide operation of the vane; and a vane controller controlling the operation of the vane in order to vary compression capacity, wherein the vane controller includes a control valve that switches a fluid channel so as to selectively apply discharge pressure and intake pressure to the vane guide slot, a connection channel that connects the control valve with the vane guide slot, a high-pressure channel that connects the control valve with a discharge side of the compressor, and a low-pressure channel that connects the control valve with an intake side of the compressor, and a throttle section that reduces the fluid channel of at least one of the high-pressure channel and the connection channel in order to reduce an initial discharge pressure applied to the vane guide slot, the vane controller includes a connection pipe forming the connection channel, a high-pressure pipe forming the high-pressure channel, and a low-pressure pipe forming the low-pressure channel, and the throttle section includes a throttle pipe that is connected to at least one of the high-pressure pipe and the connection pipe and has an inner diameter smaller than that of any one of the high-pressure pipe and the connection pipe.

2. A variable capacity rotary compressor comprising:

a housing having first and second compression chambers partitioned each other;

first and second compression units provided in the first and second compression chambers, respectively, the first and second compression units being connected to a motor element through a rotating shaft;

first and second vanes moving backwards and forwards in radial directions of the first and second compression chambers and partitioning the first and second compression chambers;

first and second vane guide slots formed in the housing in order to guide operation of the first and second vanes; and a vane controller controlling the operation of the first vane in order to vary compression capacity, wherein the vane controller includes a control valve that switches a fluid channel so as to selectively apply discharge pressure and intake pressure to the first vane guide slot, a connection channel that connects the control valve with the first vane guide slot, a high-pressure channel that connects the control valve with a discharge side of the compressor, and a low-pressure channel that connects the control valve with an intake side of the compressor, and a throttle section that reduces the fluid channel of at least one of the high-pressure channel and the connection channel in order to reduce an initial discharge pressure applied to the first vane guide slot, the vane controller includes a connection pipe forming the connection channel, a high-pressure pipe forming the high-pressure channel, and a low-pressure pipe forming the low-pressure channel, and the throttle section includes a throttle pipe that is connected to at least one of the high-pressure pipe and the connection pipe, and has an inner diameter smaller than that of any one of the high-pressure pipe and the connection pipe.

* * * * *

UNITED STATES PATENT AND TRADEMARK OFFICE

CERTIFICATE OF CORRECTION

PATENT NO. : 7,775,782 B2
APPLICATION NO. : 11/898049
DATED : August 17, 2010
INVENTOR(S) : Ji Hoon Choi et al.

It is certified that error appears in the above-identified patent and that said Letters Patent is hereby corrected as shown below:

Title page, item [75] Col. 1 (Inventors), Line 2 Delete "Il" and insert -- II --, therefor.

Signed and Sealed this
Eighteenth Day of January, 2011

David J. Kappos

David J. Kappos
*Director of the United States Patent and Trademark Office*